US009295898B2

(12) United States Patent
Lee

(10) Patent No.: US 9,295,898 B2
(45) Date of Patent: Mar. 29, 2016

(54) GOLF PUTTING APPARATUS

(71) Applicant: Jung Hoon Lee, San Jose, CA (US)

(72) Inventor: Jung Hoon Lee, San Jose, CA (US)

( * ) Notice: Subject to any disclaimer, the term of this patent is extended or adjusted under 35 U.S.C. 154(b) by 0 days.

(21) Appl. No.: 14/304,664

(22) Filed: Jun. 13, 2014

(65) Prior Publication Data

US 2015/0360111 A1 Dec. 17, 2015

(51) Int. Cl.
*A63B 69/36* (2006.01)
*A63B 67/02* (2006.01)

(52) U.S. Cl.
CPC ..... *A63B 69/3661* (2013.01); *A63B 69/3676* (2013.01); *A63B 67/02* (2013.01); *A63B 2210/50* (2013.01)

(58) Field of Classification Search
CPC ..... A63B 67/02; A63B 69/3676; A63B 69/3661; A63B 57/0056
USPC ..... 473/157, 159, 162, 164, 180, 181, 179
See application file for complete search history.

(56) References Cited

U.S. PATENT DOCUMENTS 3,610,631 A * 10/1971 Mulherin ..... 473/181
3,817,535 A * 6/1974 Doughty ..... 473/185
4,114,889 A * 9/1978 Midana ..... 473/159
4,344,624 A * 8/1982 Laursen ..... 473/159
4,886,274 A * 12/1989 Park ..... 473/164
4,988,106 A * 1/1991 Coonrod ..... 473/160
5,409,231 A * 4/1995 Kueng et al. ..... 473/261
5,720,667 A * 2/1998 Tu ..... 473/162
6,902,491 B2 * 6/2005 Barlow et al. ..... 473/175
7,140,971 B2 * 11/2006 Trudeau ..... 473/180
7,258,621 B2 * 8/2007 McDuffee ..... 473/162
7,556,566 B2 * 7/2009 Shin ..... 473/162
8,864,596 B1 * 10/2014 Maranian, Jr. ..... 473/162
9,028,336 B2 * 5/2015 Vancho et al. ..... 473/157
9,089,758 B2 * 7/2015 McWilliams
2003/0096658 A1 * 5/2003 Elliott ..... 473/162
2013/0231199 A1 * 9/2013 Stockton et al. ..... 473/157

OTHER PUBLICATIONS http www.eyelinegolf.com product sputting-sword-just-released, printed Apr. 15, 2015.

* cited by examiner

*Primary Examiner* — Mark Graham
(74) *Attorney, Agent, or Firm* — Innovation Counsel LLP

(57) ABSTRACT

A golf putting apparatus that is portable and designed to enhance a golfer's skill level is presented. The apparatus includes a strip made of a flexible material that is configured to form an elongated flat surface in an extended position, and a carrier unit configured to detachably couple with the strip. The carrier unit has a first wall around which the strip is wound for storage, the first wall defining a cavity that is configured to catch a ball that travels off an end of the strip.

18 Claims, 10 Drawing Sheets

GOLF PUTTING APPARATUS

TECHNICAL FIELD

The disclosure relates to a golf putting apparatus. In particular, it discloses a golf putting apparatus including a putting strip that can be extended flat for use and stored within the golf putting apparatus.

BACKGROUND

Golf is a widely popular sport today enjoyed by men and women of all ages. Especially for individuals in urban areas who spend a lot of time in confined spaces and/or have busy schedules, being out in a golf course is appealing for many reasons. While the fact that a golf course is a large piece of open land with lots of greenery enhances its appeal to many players, that very aspect of the sport can also make practicing golf difficult. For example, getting a practice in may entail traveling to a driving range or a golf course with one's bulky gear. Depending on how far a player is from a driving range of a golf course, it may or may not be possible to get a quick practice in during short breaks at work or even during lunch.

In an attempt to address this issue, there are golf practicing apparatuses in the market today that allow individuals to practice without traveling to the golf course. These apparatuses are often designed to be used indoors, to provide a convenient and quick way to squeeze in some practice. Putting especially lends itself well to indoor practice, as the ball does not travel high or far.

Unfortunately, golf putting practice devices that are currently on the market are typically bulky and lack portability. Moreover, many putting strips in those golf putting practice devices are generally not optimized to push the limits of a golfer's putting ability. In fact, many practice apparatuses provide a distorted sense of one's skill level to a user because they are easier than a real course. For this reason, a golfer who feels confident after practicing with an indoor apparatus may end up puzzled as to why his score on the golf course is not as good as he expected.

Accordingly, there is a need for a golf putting practice device that is easy to use and designed to enhance a golfer's skill level.

SUMMARY OF THE DISCLOSURE

In one aspect, the inventive concept pertains to a portable golf putting apparatus. The apparatus includes a strip made of a flexible material that is configured to form an elongated flat surface in an extended position. The strip is configured to detachably couple with a carrier unit. The carrier unit has a first wall around which the strip is wound for storage, the first wall defining a cavity that is configured to catch a ball that travels off an end of the strip.

Optionally, the carrier unit may have a second wall enclosing the first wall to form a space for containing the wound-up strip. The first wall and the second wall may be turned relative to each other (e.g., in opposite directions) to wind the strip around the first wall inside the second wall.

DETAILED DESCRIPTION

A putting practice apparatus that is easy to transport and store is presented. While the disclosure focuses on a few embodiments of the inventive concept for clarity and simplicity of illustration, it should be understood that the embodiments shown here are not exhaustive and there are many other ways in which the inventive concept may be practiced.

Figure 1A:
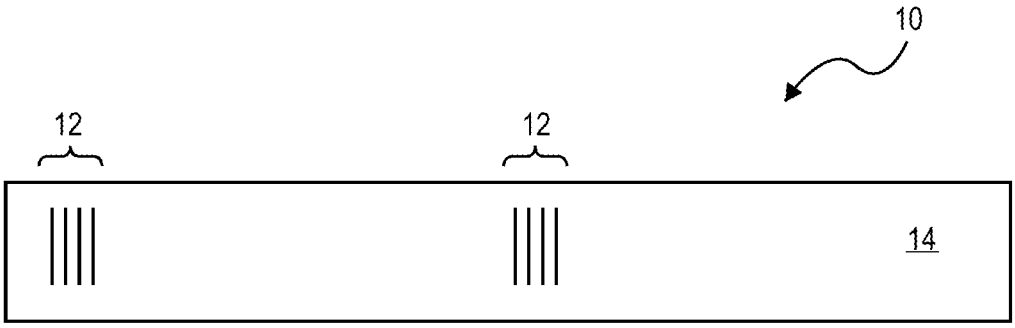
FIG. 1A depicts a top view of a putting strip in accordance with one embodiment of the inventive concept.
Figure 2:
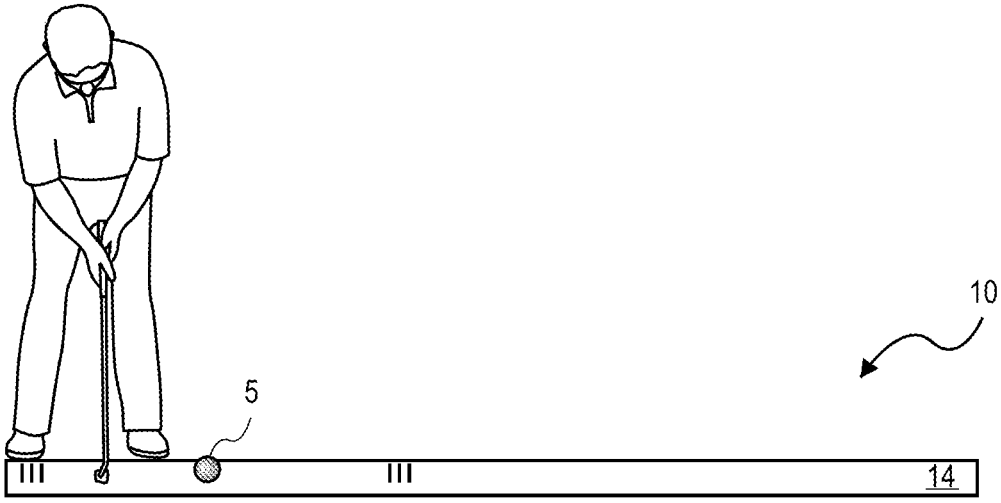
FIG. 2 depicts a golfer using the putting strip of the inventive concept.

FIG. 1A depicts a putting strip 10 in accordance with one embodiment of the inventive concept. The putting strip 10 of this embodiment is an elongated piece of flexible material that may be rolled up, folded, or otherwise shaped in a compact form for storage and be extended for use. During use, the putting strip 10 functions as a putting green, as shown in FIG. 2. A golfer places a ball 5 (e.g., a golf ball) on the putting strip 10 and hits it with his golf club to make the ball roll down the length of the putting strip 10. The strip 10 may be made to be any suitable length l, and is not limited to any specific dimensions. The golfer may place the ball anywhere he wants along the putting strip 10 to improve his skills in putting a desired distance. To cover the range of frequently-occurring putting distances during a golf game, the putting strip 10 may be made to be about 5-ft. long.

One goal when practicing with the strip 10 is to keep the ball on the putting strip 10. Hitting the ball off the strip 10 (i.e., off the intended direction) would indicate to the user that somehow his swing was not a good one. The strip 10 extends straight, as a ball usually travels straight absent any irregularities and slopes on the ground. The width w of the strip 10 may be made wider or narrower depending on how challenging it is intended to be. The wider the strip 10, the more forgiving it will be because the user does not have to hit the ball perfectly in the intended direction to keep the ball on the strip 10. A beginner golfer may use a wider strip 10 to practice his putting, to gain a "feel" of how the ball reacts to his swing. A more advanced golfer may use a narrow strip 10 where a small miscalculation, loss of focus, or twitch could cause the ball to roll off the strip 10. In one embodiment, the width w of the putting strip 10 may be about 2 inches. Given that an average golf ball has a diameter of about 1.6-1.7 inches, a 2-inch width would provide a 17-25% margin of error.

Figure 1B:
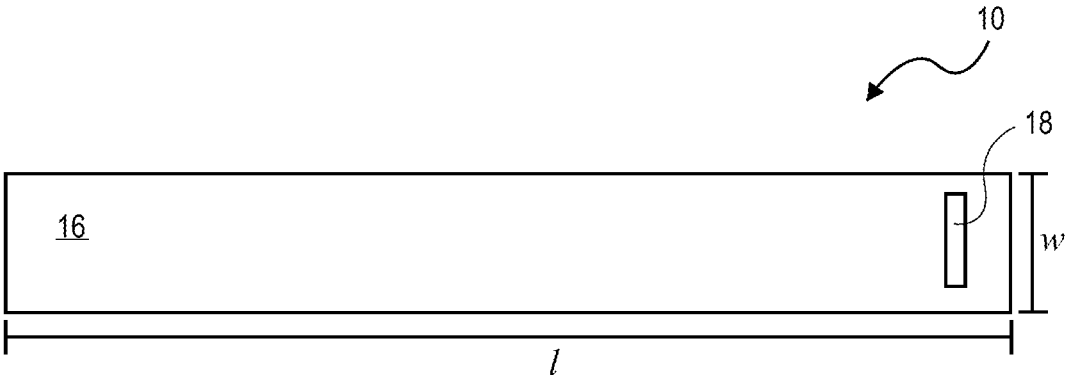
FIG. 1B depicts a bottom view of a putting strip in accordance with one embodiment of the inventive concept.

As depicted in FIG. 1A and FIG. 1B, the putting strip 10 may have a first surface 14 and a second surface 16. The first surface 14 may be the surface that faces up during use, as shown in FIG. 2. The second surface 16 may be the surface that contacts the ground, or the surface opposite the first surface 14. As shown in FIG. 1A, there may be markings 12 made on all or select portions of the first surface 14 to guide one's swing. In the particular embodiment, the markings 12 include lines drawn perpendicularly to the long edges of the strip 10. As many golfers attempt to keep the club face perpendicular to the intended travel direction of the ball, keeping the club surface aligned with the markings 12, for example during backswing, will usually allow the ball to travel down the strip 10. Hence, a user is able to evaluate his own backswing, i.e. by seeing if the club face is being tilted at an angle relative to the markings 12. A "club face," as used herein, is intended to mean the surface of the golf club that intentionally contacts the ball to set the ball in motion. In some alternative embodiments, the markings 12 may be omitted from the putting strip 10.

The strip 10 may be made of a reflective material, such as a metal. In some embodiments, just the first surface 14 may be reflective. The reflective nature of the first surface 14 allows the golfer to check his physical alignment with the ball. Many golfers, during putting, strive to align themselves with the ball by positioning their eyes above the ball. The reflective nature of the first surface 14 allows a golfer to make sure that his eyes are aligned with the ball without lifting his head, and also allows a golfer to check if he is moving his head excessively during a swing.

The surface of the putting strip 10 may be made smooth to increase the sensitivity of the ball in reaction to a force. If desired, the strip 10 may be textured to simulate different green conditions. While the thickness of the putting strip 10 is not limited to any particular dimension as long as the strip 10 can be extended to form a flat surface and rolled up or otherwise formed into a compact shape for storage.

The putting strip 10 may be made of a spring-tempered metal or metal alloy in part or in whole, such as spring-tempered stainless steel, spring-tempered bronze, spring-tempered brass, or spring-tempered copper. Spring-tempered metal or alloy (e.g., stainless steel, bronze, brass, or copper) allows the strip 10 to be rolled up or otherwise made compact for storage, and allows it to lie flat without showing a memory of the position in which it was stored. This is desirable, as most golfers do not want a 5-ft. long strip 10 extending across their floors when they are not practicing putting. Spring-tempered stainless steel, brass, bronze, or copper is a suitable choice for this application also because it is reflective. As mentioned above, the reflective property of the surface allows the user to evaluate his swing easily. The strip 10 should be heavy enough that it does not wrinkle or crumple when the ball rolls on it. The strip 10 is not limited to being made of spring-tempered metal or metal alloy, and may be made of any suitable material that does not show the position it was stored in, possesses the reflective property, and the weight described above. In some embodiments, a weight may be attached to one end or another part of the strip 10.

FIG. 1B depicts the second surface 16 of the putting strip 10. As shown, the second surface 16 may have a first attachment mechanism 18 formed thereon. In the particular embodiment shown, the first attachment mechanism 18 is formed near one end of the second surface 16. However, this is not a limitation of the invention. As will be described in more detail below, the first attachment mechanism 18 allows the strip 10 to be attached to a carrier 100.

Figure 1C:
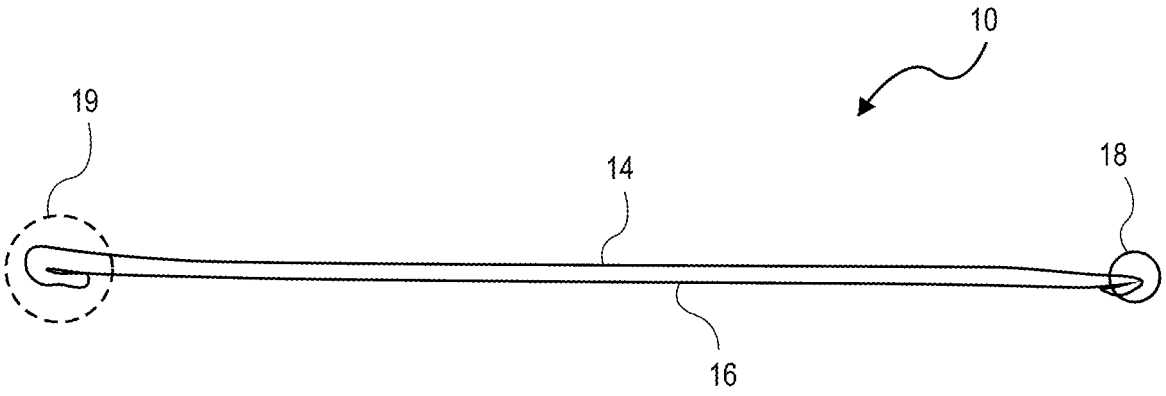
FIG. 1C depicts a side view of a putting strip in accordance with one embodiment of the inventive concept.

FIG. 1C depicts a side view of the putting strip 10 in accordance with one embodiment. In the particular embodiment, the first attachment mechanism 18 is a hook formed at an end of the putting strip 10. The first attachment mechanism 18 may be formed near a first end of the putting strip 10 that has no markings 12 thereon. The second end of the putting strip 10 may have a slope structure 19, which is a structure that helps raise that end of the strip 10 to form a gentle slope. A gentle slope at the second end of the strip 10 makes it easier for the golfer to see the markings 12 during a backswing by raising the markings 12 consistently with the curved trajectory of the club head during a swing. The club head is thus not as far from the markings 12 as it would have been without the slope structure 19. In the particular embodiment that is depicted, the slope structure 19 includes a folded end of the strip 10. However, this is not a limitation of the inventive concept and various other structures may be used to form a slope.

Figure 3:
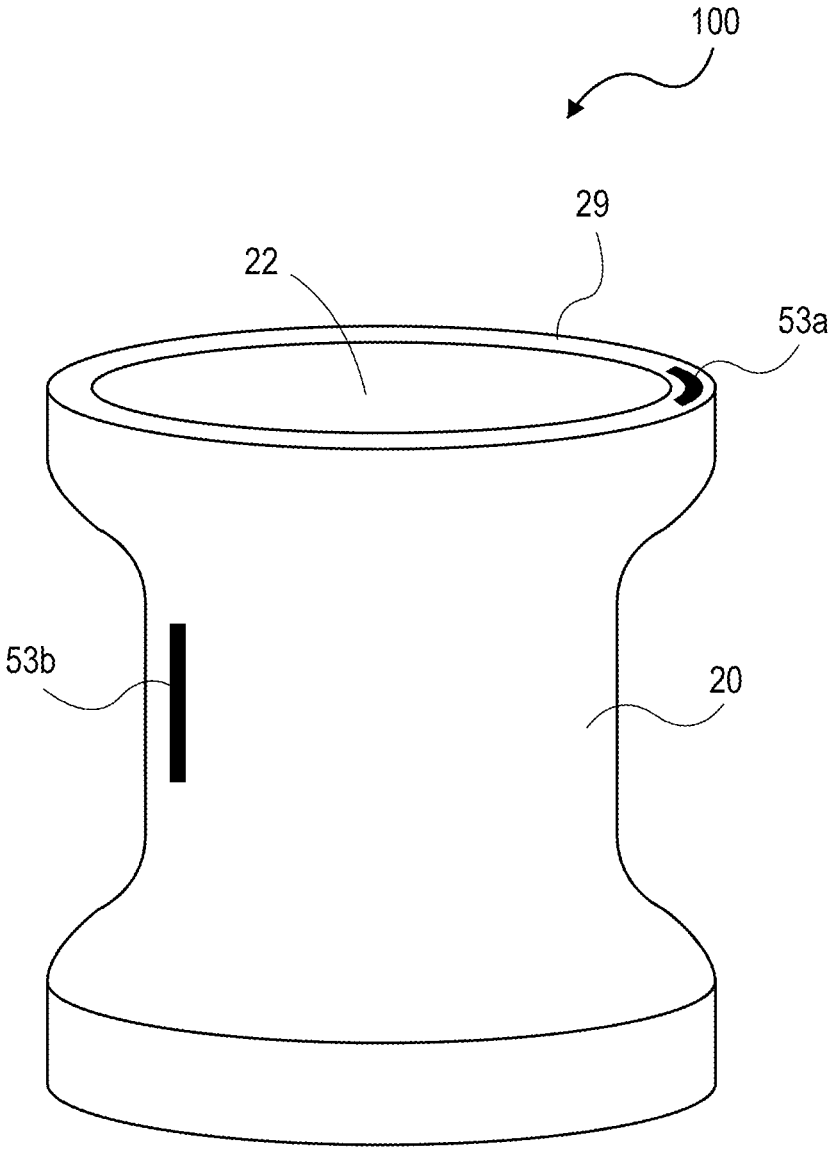
FIG. 3 depicts a first embodiment of a carrier that may be detachably coupled with the putting strip.

FIG. 3 depicts one embodiment of a multi-functional carrier 100 that may be detachably coupled with the strip 10 for putting practice. The carrier 100 includes a first wall 20 mounted on a base 40. The first wall 20 defines a cavity 22, which may have a circular shape as shown in FIG. 3. As shown, the carrier 100 includes a second attachment mechanism 53*a*, 53*b* (collectively referred to as second attachment mechanism 53) that is designed to couple with the first attachment 18. In the particular embodiment, the second attachment mechanism 53*a* is formed on a top surface 29 of the carrier 100.

Figure 7:
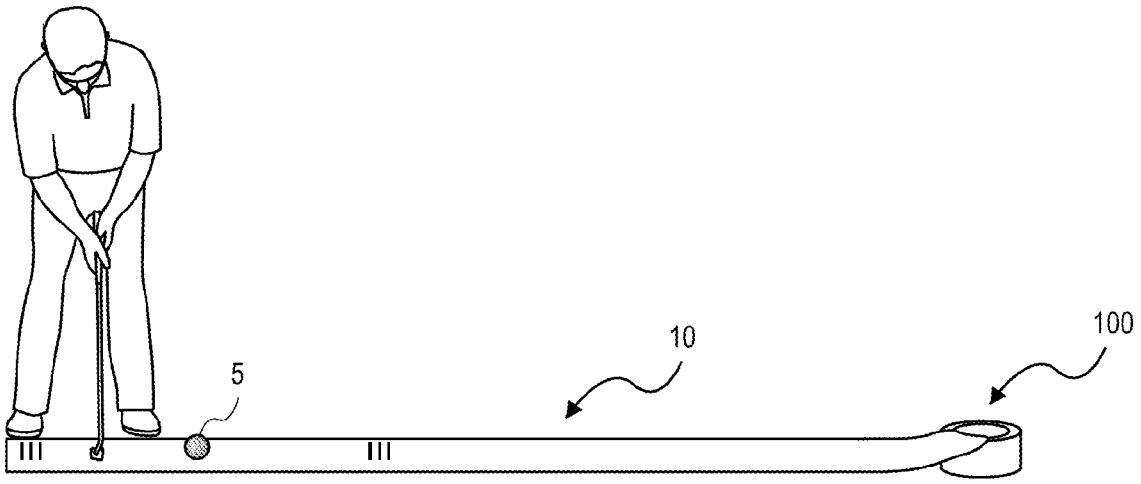
FIG. 7 depicts a golfer using the putting strip of the inventive concept coupled with the carrier.

When the putting strip 10 is being used for putting practice, the putting strip 10 is attached to the carrier 100 by coupling the first and second attachment mechanisms 18, 53*a*. In one embodiment, the first attachment mechanism 18 may be a hook, and the second attachment mechanism 53 may be a cutout into which the hook can extend. To practice putting, a golfer would attach the hook 18 to the cutout 53 and hit a ball down the strip 10, as shown in FIG. 7. If the direction and the force is right, the ball will travel down the putting strip 10 and fall into the cavity 22, which effectively functions as the "hole" of the putting green. The first and second attachment mechanisms 18, 53 may include a piece of magnet to which the putting strip 10 will stick, Velcro®, or any other fastening means. Any combination of different attachment mechanisms may be used to secure the putting strip 10 to the carrier 100.

When the strip 10 is not being used for putting practice (e.g., stored), the cavity 22 may be used for storing balls. When the putting strip 10 is not being used, it may be stored by being wrapped around the first wall 20 like a ribbon. A second attachment mechanism 53*b* may be formed on the outer surface of the first wall 20 so that when it is time to put the putting strip 10 away, the golfer can detach the strip 10 from the second attachment mechanism 53*a* and couple it to the other second attachment mechanism 53*b*. Doing so will fix one end of the putting strip 10 to the carrier 100, making it easier to wind the remainder of the strip 10 around the first wall 20. There may be a mechanism for keeping the putting strip 10 in the wound position, such as a band that fits around the first wall 20, a magnetic clip, a Velcro® strip, etc.

Figure 4A:
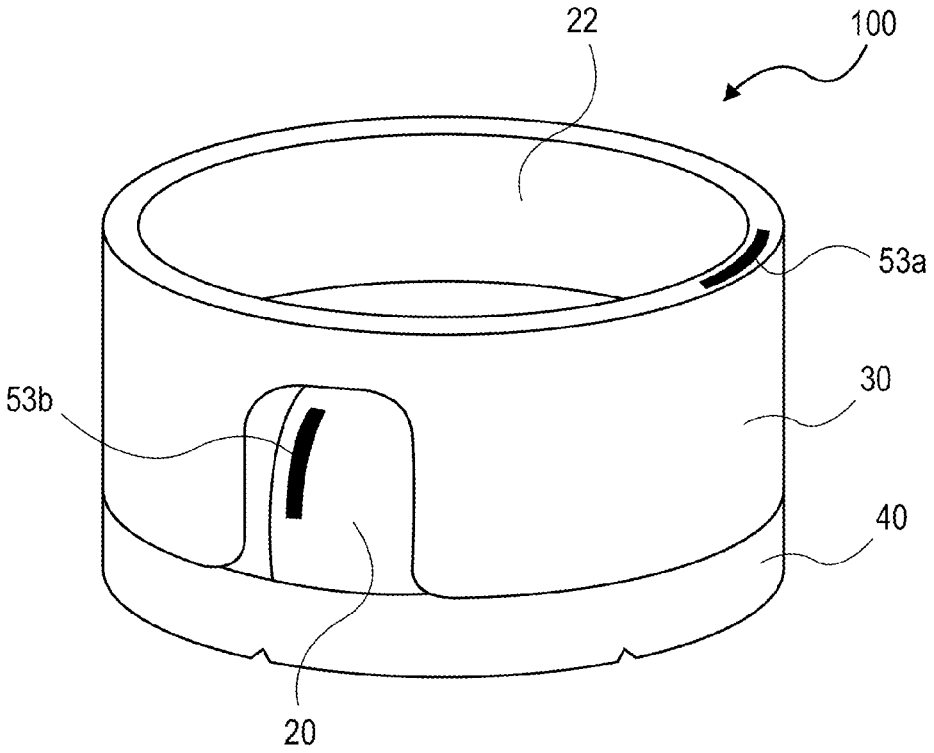
FIG. 4A depicts a second embodiment of a carrier that may be detachably coupled with the putting strip.
Figure 4B:
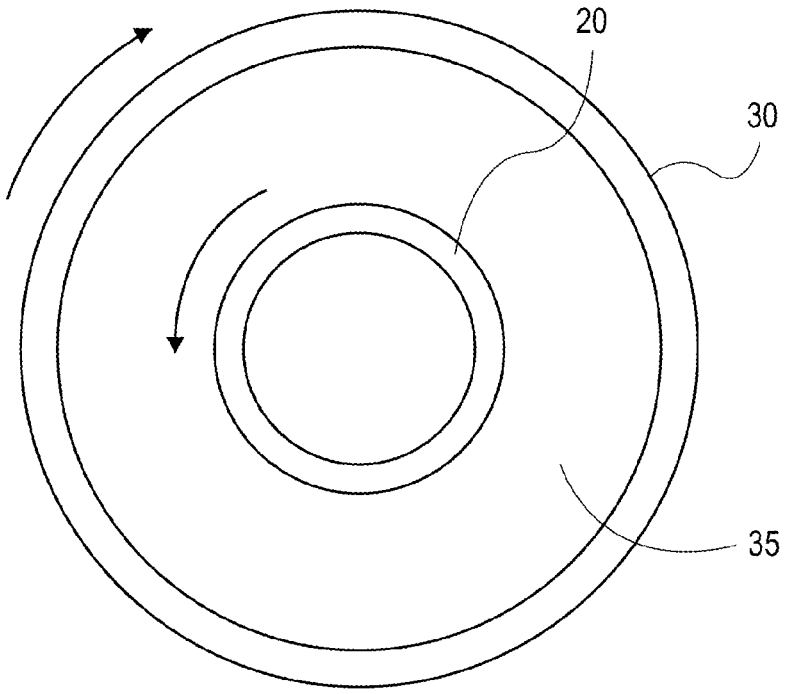
FIG. 4B depicts a horizontal cross-sectional view of the carrier shown in FIG. 4A.

FIG. 4A and FIG. 4B depict another embodiment of the carrier 100 that may be coupled with the putting strip 10. This embodiment includes two layers of circularly-shaped walls: the first wall 20 and a second wall 30 that are arranged coaxially with a space 35 between the two. The first wall 20 and the second wall 30 are circular walls of different diameters, arranged concentrically such that the first wall 20 (which is smaller) is encircled by and spaced apart from the second wall 30.

FIG. 4B, which depicts a horizontal cross section of the carrier 100 shown in FIG. 4A, shows the space 35 between the first wall 20 and the second wall 30. The putting strip 10, when not being used, may be stored in the space 35 by being wound around the first wall 20. The second wall 30, which encloses the putting strip 10, keeps the putting strip 10 in the wound position and also protects it from outside elements. The two-walled embodiment depicted in FIG. 4A and FIG. 4B provides the additional advantage of making it easy for the user to wind the strip 10 by allowing the two walls to rotate independently of each other, for example in the opposite directions as shown by the arrows in FIG. 4B.

Figure 5:
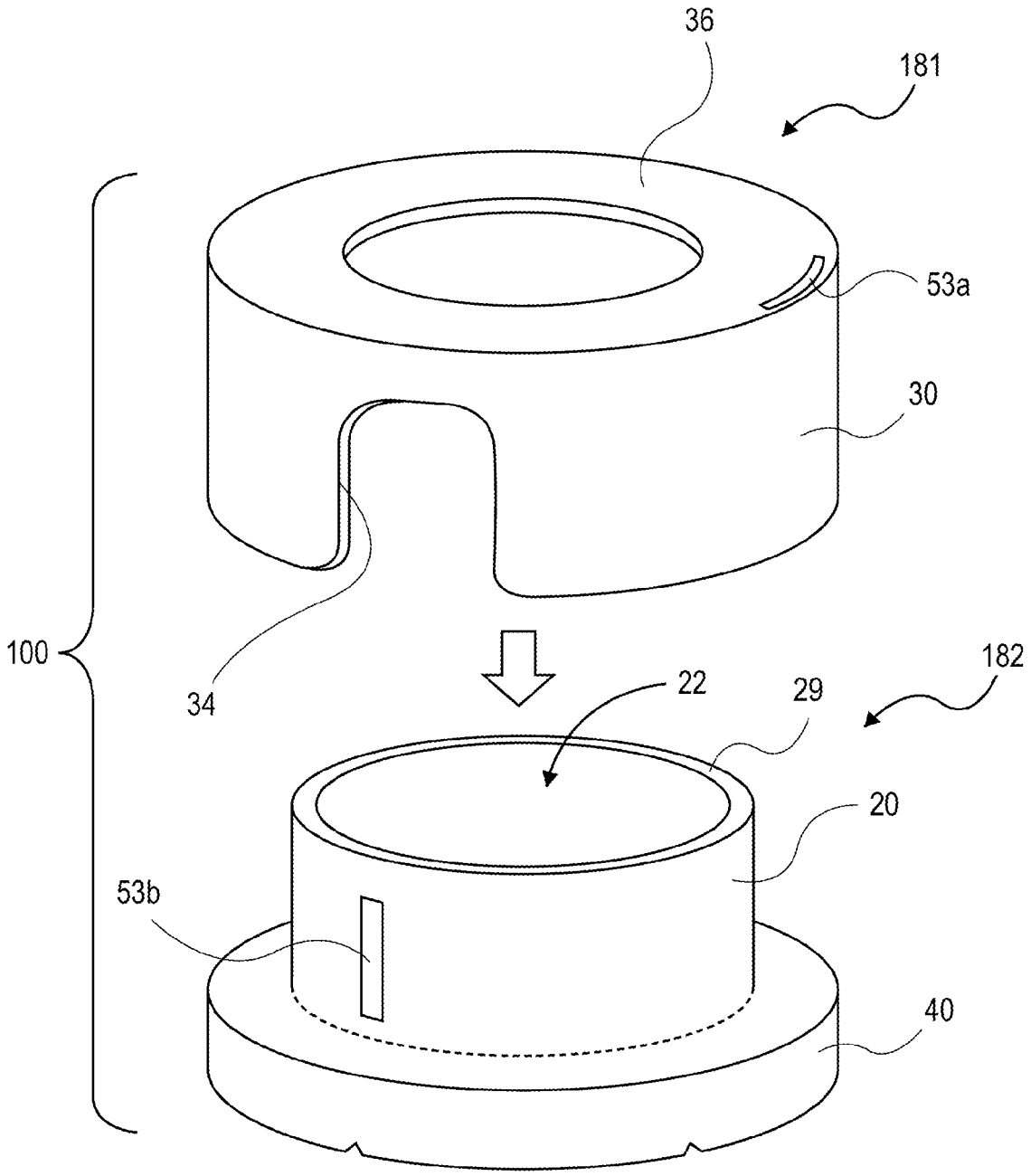
FIG. 5 depicts elements of the carrier in accordance with one embodiment of the inventive concept.

FIG. 5 depicts an implementation of the two-walled carrier 100 shown in FIG. 4A. As shown, the carrier 100 may be put together by combining a first element 181 with a second element 182. In the particular embodiment, the first element 181 includes the second wall 30 and a top surface 36, which has the second attachment mechanism 53*a* formed thereon. The second element 182 includes a base 40, the first wall 20, and the second attachment mechanism 53*b* formed thereon. Each of the first element 181 and the second element 182 may be an integrated piece made of a rigid material that gives a little, such as plastic. The first and second elements 181, 182 may be combined such that they can be rotated relative to each other, as shown above in FIG. 4B, by a user's grabbing the first element 181 with one hand and the base 40 with the other hand and turning the held pieces in opposite directions. For example, the first wall 20 may be rotated clockwise (as shown by the arrow) while the second wall 30 remains stationary or rotates counterclockwise, or vice versa. When the winding is complete, the entire putting strip 10 will be in the space 35 of the carrier 100.

The putting strip 10 may be wound around the first wall 20 and be encased by the second wall 30 for secure storage. In the embodiment of FIG. 5, the second wall 30 is connected to the upper surface 36 of the first member 181, and the first wall 20 is connected to the base 40 of the second member 182. The first and second members are coupled to form the carrier 100. In some embodiments, the upper surface 36 may be integrated with the first wall 20.

The two-walled embodiment of FIG. 4A, FIG. 4B, and FIG. 5 includes an opening 34 formed in the second wall 30. The opening 34 is formed on the first sidewall 30 such that the attachment mechanism 53*b* is exposed when it is aligned with the opening 34. As mentioned above, the second mechanism 53*a* may be formed both near the cavity 22 and on the second wall 30 (or perhaps on the edge where the two surfaces meet. As explained above, the putting strip 10 may be coupled to the second attachment mechanism 53*a* for putting practice and to the second attachment mechanism 53*b* for storage. To access the second attachment mechanism 53*b* that is on the first wall 20 (the inner wall), the end of the strip 10 that has the first attachment mechanism 18 extends in through the opening 34. For example, the user may reach in through the opening 34 holding the strip 10, or guide the strip 10 into the opening 34. Then, with the first attachment mechanism 10 securely fixed to the second attachment mechanism 18, the first wall 20 and the second wall 30 are rotated with respect to each other to wind the strip 10 for storage.

Figure 6:
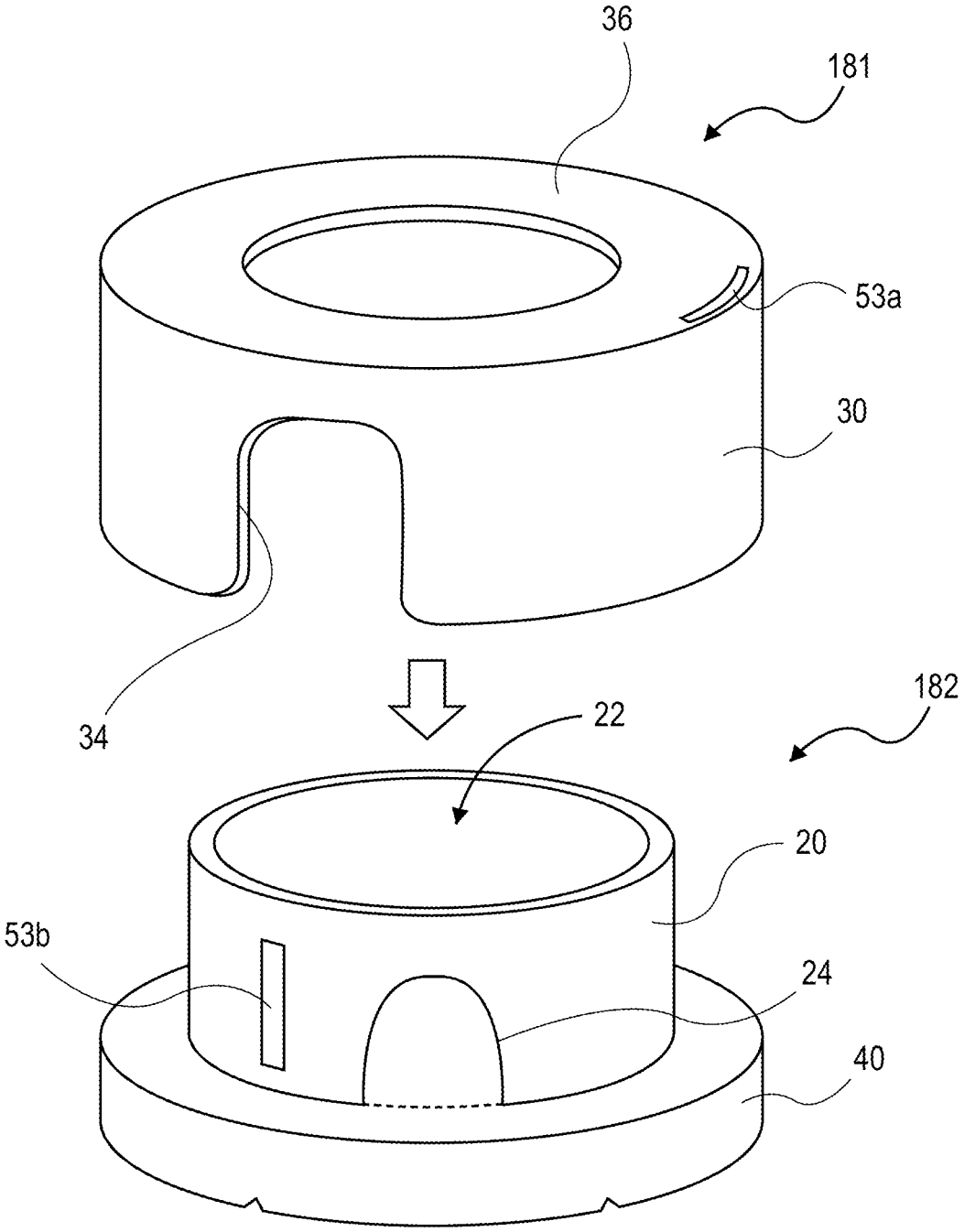
FIG. 6 depicts elements of the carrier in accordance with another embodiment of the inventive concept.

FIG. 6 depicts an alternative embodiment of the carrier 100 that includes a cutout 24 in the first wall 20. Aligning the cutout 24 with the opening 34 on the second wall 30 forms a window through which a ball can roll out of the cavity 22. The upper surface of the base 40 may be made to include a slope such that a ball that falls into the cavity 22 will roll down to the cutout 24. During putting practice, a golfer may leave the cutout 24 of the first wall 20 aligned with the opening 34 so that when a ball falls into the cavity 22, it will automatically roll out or cause one of the other balls in the cavity 22 to roll out through the window for the next put.

FIG. 7 depicts a golfer using the putting strip 10 coupled with the carrier 100. Any embodiment of the carrier 100 may be used in the manner shown.

Figure 8A:
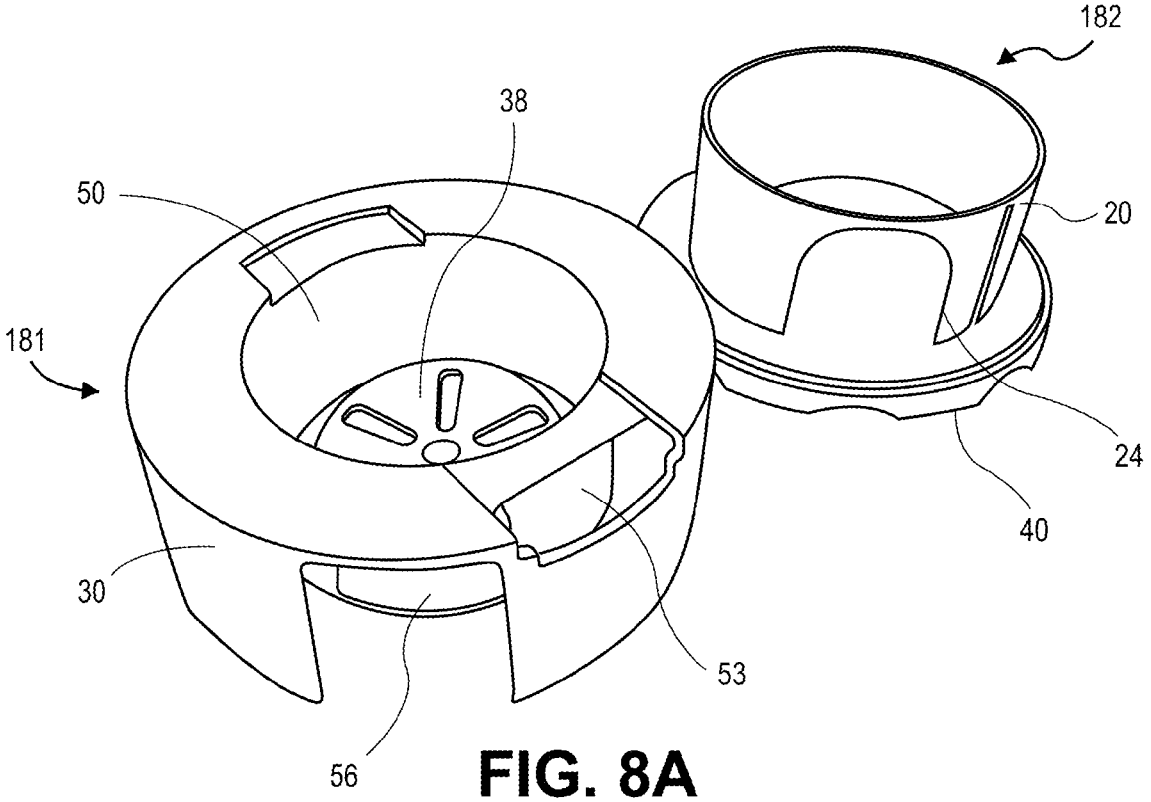
FIG. 8A depicts a third embodiment of the carrier that may be detachably coupled with the putting strip, separated into elements.
Figure 8B:
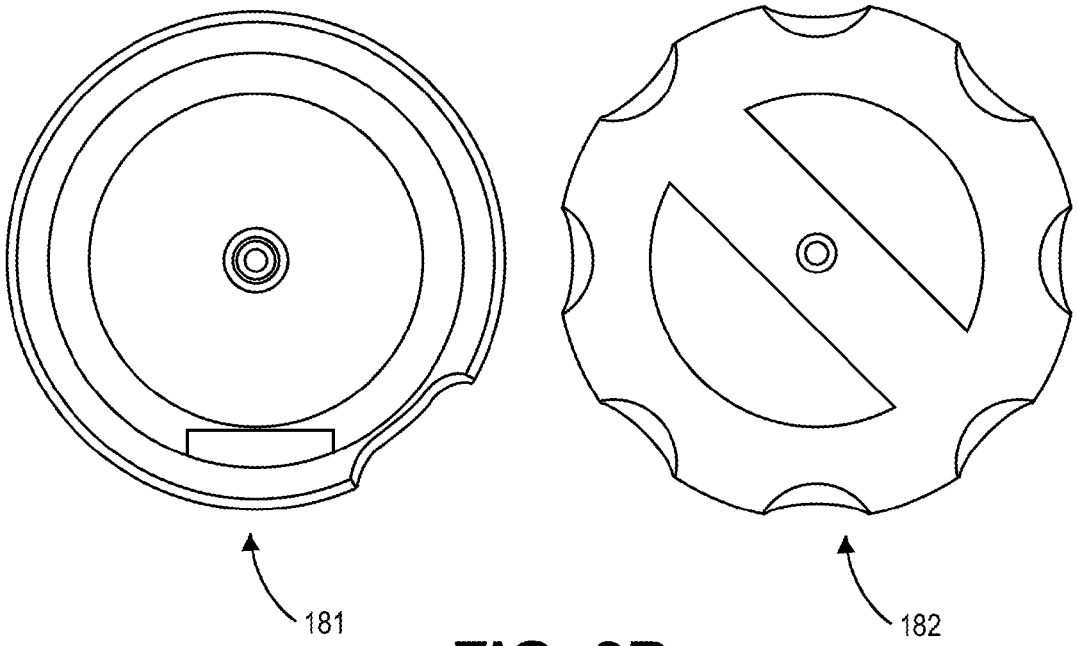
FIG. 8B depicts a bottom view of the elements of FIG. 8A.

FIG. 8A and FIG. 8B depict another embodiment of the carrier 100 in accordance with the inventive concept. In this particular embodiment, the carrier 100 has three walls. More specifically, in addition to the first wall 20 and the second wall 30, there is a third wall 50. In the particular embodiment, the three walls are circular and concentrically arranged. The second element 182 in this embodiment is substantially similar to the second element 182 in the embodiment of FIG. 6. The first element 181 in this embodiment, however, has a cup formed by the third wall 50 and a bottom 38. The second wall 30 and the third wall 50 may be connected by the top surface 36.

In this particular embodiment, the bottom 38 extends across part of the cavity 22 to form a "floor" of the cup. The third wall 50 may have an inner opening 56 that can be aligned with the cutout 24 and the opening 34 to let a ball roll out of the cup during putting practice. The bottom 38 may be tilted such that the portion near the inner opening 56 is lower than other parts, causing a ball in the cup to roll toward the inner opening 56. In some embodiments, the bottom 38 of the cup may include a moat formed along its periphery, as well as other patterns. The moat may be formed as an annular recess. As long as the cup is configured to catch a ball that rolls off the edge of the putting strip 10, the inventive concept is not limited to any shape, position, material, or pattern of the cup. The moat, for example, may be formed to reduce the amount of material that is needed to make the apparatus.

FIG. 8B depicts a bottom view of the first element 181 and the second element 182. When the first and second elements 181, 182 are combined, the first wall 20 fits between the second and third walls 30, 50.

As depicted in FIG. 8B, a plurality of grip aids 48 may be formed along the outer edge of the base 40. The semispherical cutouts 48 serve as finger-grip holders for turning the second element 182 when winding the strip 10.

Figure 8C:
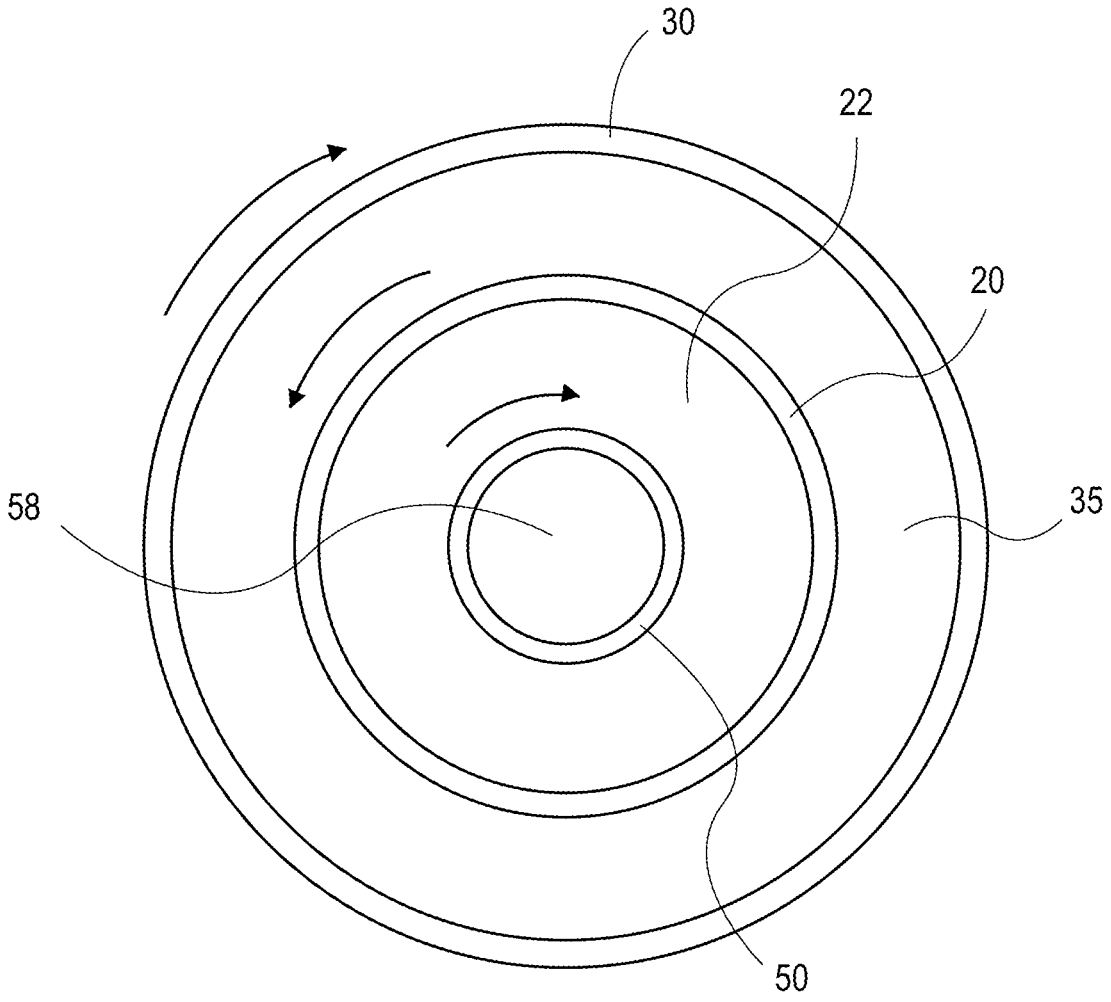
FIG. 8C depicts a horizontal cross-sectional view of the embodiment of the carrier shown in FIG. 8A.

FIG. 8C depicts a horizontal cross sectional view of the three-sidewall carrier 100 that is shown in FIG. 8A and FIG. 8B. As shown, the third wall 50 has a smaller diameter than the second wall 20 such that it fits in the cavity 22 and forms a ball-holding compartment 58. When the strip 10 is stored, it fits in the space 35 between the first wall 20 and the second wall 30. As the second wall 30 and the third wall 50 are connected to each other (e.g., by the top surface 36), they move together in the same direction, as shown by the arrows in FIG. 8C.

Figure 9A:
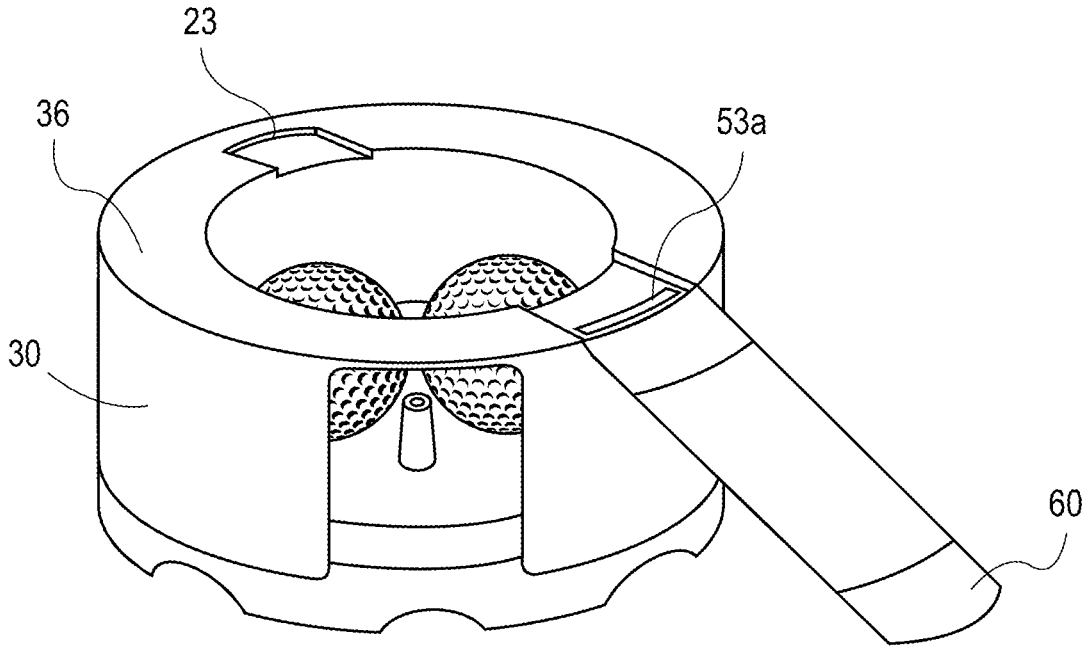
FIG. 9A depicts an embodiment of the carrier of the inventive concept that includes a latch in an open position.
Figure 9B:
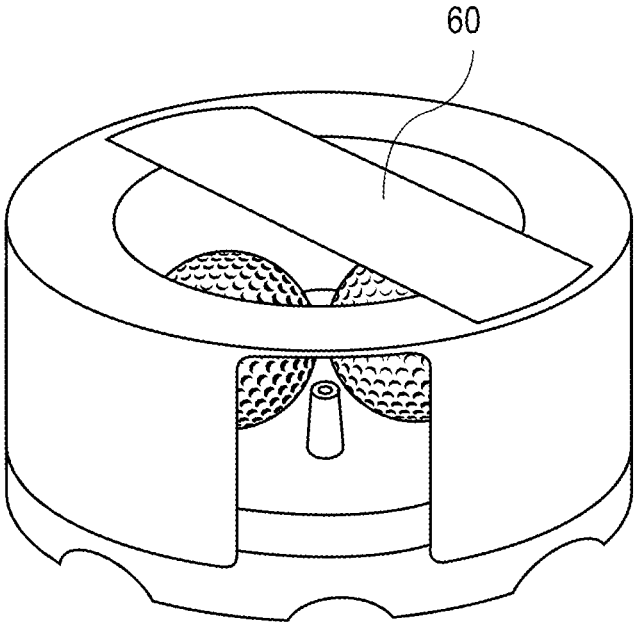
FIG. 9B depicts the carrier of FIG. 9A with the latch in a closed position.

FIG. 9A and FIG. 9B depict an embodiment of the carrier 100 that includes a latch 60 that can be closed to secure balls in the cavity 22 so that they do not roll out during storage or transport. With the latch 60 closed, the carrier 100 can be stored or carried in any position without the balls getting lost. The second attachment mechanism 53*a* may be formed on the latch 60 instead of directly on the first element 181, as shown in FIG. 9A. Recesses 23 may be formed on the top surface 36 connected to the second wall 30 to accommodate the latch 60. A mechanism (not shown) may be implemented to "lock" the latch 50 in the closed position, for example a magnet, Velcro®, a mechanical lock (e.g. to "snap" into place), or some type of sticky surface, among other possibilities.

In the embodiment of FIG. 9A, the latch 60 is attached to a top edge of the wall 20 by a hinge. The latch 60 is configured to be rotated about the hinge to be opened and closed. When the apparatus is not being used for putting practice, balls may be placed in the cavity 22 and the latch 60 may be in the closed position to prevent the balls from falling out, as shown in FIG. 9B. During putting practice, the latch 60 may be in the "open" position as shown in FIG. 9A, and the putting strip 10 may be attached to the second attachment mechanism 53*a*. There will be a gentle upward hill just before the hole (cavity 22) for extra challenge.

In the preceding specification, the inventive concept has been described with reference to specific exemplary embodiments. It will, however, be evident that various modifications and changes may be made without departing from the broader spirit and scope of the inventive concept as set forth in the claims that follow. The specification and drawings are accordingly to be regarded as illustrative rather than restrictive. Other embodiments of the inventive concept may be apparent to those skilled in the art from consideration of the specification and practice of the concept disclosed herein.

What is claimed is:

1. A golf putting apparatus comprising:

a strip made of a flexible material that is configured to form an elongated flat surface in an extended position, wherein the flexible material contains spring-tempered metal or metal alloy;

a carrier unit configured to detachably couple with the strip, the carrier unit having a first wall around which the strip is wound for storage, the first wall defining a cavity that is configured to catch a ball that travels off an end of the strip.

2. The apparatus of claim 1, wherein the flexible material is at least one of spring-tempered stainless steel, spring-tempered bronze, spring-tempered brass, and spring-tempered copper.

3. The apparatus of claim 1, wherein the strip is about 2-inches wide.

4. The apparatus of claim 1, wherein the flexible material includes a reflective surface.

5. The apparatus of claim 1 further comprising a first attachment mechanism formed on the strip to detachably couple to a second attachment mechanism on the carrier unit.

6. The apparatus of claim 5, wherein the first attachment mechanism is a hook positioned near an end of the strip, and the second attachment mechanism is a cutout into which the hook extends.

7. The apparatus of claim 1 further comprising a second wall that surrounds and is spaced apart from the sidewall to form a space between the first wall and the second wall, wherein the first wall and the second wall are configured to rotate coaxially with respect to each other.

8. The apparatus of claim 7, wherein the first wall and the second wall are arranged such that their cross sections include concentric circles.

9. The apparatus of claim 7, wherein the first wall extends out of a base and forms an integrated element with the base.

10. The apparatus of claim 7, wherein a top surface extends perpendicularly to the first and second walls and is integrated with the second wall.

11. The apparatus of claim 7, wherein the first wall includes a cutout and the second wall includes an opening, such that the cutout and the opening being aligned creates a window into the cavity.

12. The apparatus of claim 7 further comprising an opening in the second wall through which an attachment mechanism on the first wall is exposed, allowing the strip to be attached to the first wall and wound around the first wall with rotation of the second wall relative to the first wall.

13. The apparatus of claim 7 further comprising a third wall that is connected to the second wall via a top surface and configured to fit in the cavity, wherein the first wall is positioned between the second wall and the third wall.

14. The apparatus of claim 13 further comprising a bottom surface extending across an end of the third wall to form a cup.

15. The apparatus of claim 14, wherein the third wall comprises an inner opening that allows a ball to roll out of the cup, wherein the bottom surface is slanted with the lowest portion being near the inner opening.

16. The apparatus of claim 1 further comprising a latch that is configured to open and close the cavity.

17. The apparatus of claim 1, wherein the strip is configured to have a width that is 17-25% wider than a ball intended to be used on the strip.

18. The apparatus of claim 1, wherein the strip comprises:

an attachment mechanism on a first end by which the strip couples to the carrier unit; and a slope structure on a second end that raises the second end of the strip to create a slope.

* * * * *